US006439153B1

(12) United States Patent
Gemmell

(10) Patent No.: US 6,439,153 B1
(45) Date of Patent: Aug. 27, 2002

(54) QUEUING SYSTEM

(76) Inventor: Wayne Gemmell, 2520 Pasqua Street, Regina, Saskatchewan (CA), S4S 0M2

( * ) Notice: Subject to any disclaimer, the term of this patent is extended or adjusted under 35 U.S.C. 154(b) by 55 days.

(21) Appl. No.: 09/655,857

(22) Filed: Sep. 6, 2000

(51) Int. Cl.[7] ..... A63F 9/00
(52) U.S. Cl. ..... 116/222; 116/DIG. 3
(58) Field of Search ..... 116/222, 223, 116/224, 225, 284, 327, 306, 318, 321, 323, 324, DIG. 3, DIG. 23; 273/153 S

(56) References Cited

U.S. PATENT DOCUMENTS 785,665 A * 3/1905 Coe ..... 273/153 S
3,861,678 A 1/1975 Fansler
4,016,937 A 4/1977 Abraham
4,373,732 A * 2/1983 Ogillvie ..... 273/271
4,509,756 A * 4/1985 Moscovich ..... 273/153 S
4,871,173 A * 10/1989 Lammertink ..... 273/153 S
5,167,571 A * 12/1992 Waller ..... 453/29
5,505,665 A 4/1996 Bumstead
5,590,810 A 1/1997 Wehbi
5,622,368 A * 4/1997 Chang ..... 273/153 S

* cited by examiner

*Primary Examiner*—Diego Gutierrez
*Assistant Examiner*—Travis Reis
(74) *Attorney, Agent, or Firm*—Murray E. Thrift

(57) ABSTRACT

A queuing system is provided for queuing conventional coins corresponding to a line of persons. The system includes an endless track supporting tokens therein for sliding movement in a first direction along the track. The tokens are arranged to support the coins therein. An indicator on the track indicates a first coin to be queued. Movement of the tokens in the first direction displaces the tokens towards the indicator for indicating a queuing order of the coins. The queuing system is particularly useful for coin operated pool tables and the like where the use of coins is known to represent a queue of persons.

20 Claims, 4 Drawing Sheets

QUEUING SYSTEM

FIELD OF THE INVENTION

This invention relates to a queuing system and more particularly to a queuing system for representing the sequence of individuals in a queue.

BACKGROUND

Persons are often required to wait in line for a particular service or for example when taking turns to play a game. It is often difficult to keep track of whose turn it is in such instances. In some instances when playing games like pool, players waiting for a turn do not stand in line, but put down a coin in a row of coins and retire to a seat to watch and await their turn. The row of coins represent the queued players. Problems are associated with this practice however due to a lack of indication of the order of the coins as well as interference of the coins positions by persons playing the pool game. Coins are known to be misplaced or cause interference with the play of the game because it is standard practice to place the coins along one of the rails of a pool table.

U.S. Pat. No. 3,861,678 to Fansler and U.S. Pat. No. 4,016,937 to Abraham each provide a device which is arranged to mount on the rail of a pool table for supporting coins in a sequence representing the sequence of players queued. Despite providing an indication of the order of the queued players these devices are not reliable because they both require an individual to manually advance each coin individually thereon to avoid confusion when the device is fully loaded with coins. Furthermore, the coins may easily be displaced through interference from a person playing the game so as to provide further confusion as to which coin indicates the next person to be queued.

U.S. Pat. No. 5,590,810 to Wehbi provides a participation control device which includes a plurality of rotatable chambers which are arranged to receive numbered tokens therein to indicate an order of the play of the participants. The device however requires significant manipulation by the participants to insert and remove the tokens so as to present significant opportunity for confusion and misplacement of the tokens when in use.

SUMMARY

According to one aspect of the present invention there is provided a queuing system comprising:

a plurality of tokens;

an endless track supporting the tokens therein for sliding movement in a first direction along the track; and an indicator on the track corresponding to a first token to be queued;

wherein the first direction corresponds to displacement of the tokens towards the indicator for indicating a queuing order.

The use of a track in combination with tokens for identifying persons in a queue permits the tokens to be advanced in a sliding movement towards a fixed indicator for clearly indicating who is due to be called next from the queue. This arrangement removes the confusion normally associated with fixed tokens and an indicator which varies in position to indicate which token is to be called next. The arrangement of the track further permits the tokens to be partially or fully shielded within the track to prevent the tokens from being misplaced. This is particularly useful on pool tables and the like where a queue of coins is commonly misplaced due to interference from play of the pool game.

The term token is used as a generic term to include anything that travels along the track and serves to identify an individual member of a queue. The tokens may be conventional coins or other track followers referred to herein as travellers. The travellers may carry coins. The use of conventional coins avoids confusion as coins are already known to represent a queue of persons.

Preferably there is provided indicia on the track in alignment with the tokens in the track, the indicia corresponding to the positions in the queue representing the respective tokens.

The system may include a stop member arranged to engage the tokens to restrict displacement of the tokens in a second direction opposite the first direction. The stop member ensures that the tokens are advanced in the proper direction towards the indicator so as to minimise errors in the order due to misuse.

The endless track may be formed by a pair of elongate and parallel side portions and a pair of curved end portions coupled between respective ends of the side portions. The shape of the track is thus suitably arranged for mounting along the rail of a pool table without interfering with the playing surface of the pool table.

The track may include mounting means for mounting the track on an upright supporting surface.

A mounting flange extending laterally outward from the track and spaced upwardly from a bottom side of the track is useful for recessing the queuing system into the rail of a pool table to further minimise the interference between the queuing system and the play of the pool game.

According to a second aspect of the present invention there is provided a queuing system for queuing conventional coins, the queuing system comprising:

a plurality of tokens, each token being arranged to support one of the conventional coins therein;

an endless track mounting the tokens therein for sliding movement in a first direction along the track; and an indicator on the track for indicating which token corresponds to a first coin to be queued;

wherein the first direction corresponds to displacement of the tokens towards the indicator for indicating a queuing order of the coins.

The stop member is preferably formed on the track, the stop member being arranged to engage the tokens to restrict displacement of the tokens in a second direction opposite the first direction. The stop member ensures that the tokens are advanced in the proper direction towards the indicator so as to minimise errors in the order due to misuse.

Positioning the tokens end to end to fill the track permits a user to advance only a single token towards the indicator while the remainder of the tokens are displaced with the token about the endless track so to be also displaced towards the indicator.

Where the token is a traveller for carrying a coin, it preferably includes a coin release mechanism arranged to release a coin from the token. When there is provided a circular indent in each token suitably sized to receive the coin therein, the coin release mechanism preferably comprises a recessed portion adjacent a periphery of the indent. The circular indent may comprise a flat central portion for supporting the coin thereon with the recessed portion comprising an annular recess about a periphery of the circular indent.

The system may include a stop member adjacent the indicator on the track so as to restrict displacement of the tokens in the first direction past the stop member until a coin supported thereon has been removed. This is to ensure that the tokens are not advanced past the indicator until the persons associated with the coins thereon have already been called from the queue and removed their coins.

There may be provided a flange mounted along the track to extend partially over the tokens so as to restrict removal of the tokens from the track. The use of a flange to restrict removal of the tokens ensures that the tokens are not tampered with.

There may be provided a magnetic element mounted within each token for assisting in supporting the coins on the respective tokens. The use of a magnetic element in combination with the flange for retaining the tokens within the track is particularly useful when supporting the track on a generally vertical supporting surface, for example the side of a pool table, proximal wall or post.

The track may include mounting means for mounting the track on an upright supporting surface.

Each token preferably includes a different indicia thereon for indicating which person corresponds to each coin supported on the tokens. This arrangement permits persons to use a common type of coin while still being able to identifying which coin is theirs.

The track may comprise a trough supporting the tokens therein for sliding movement along the trough. The tokens themselves may be travellers of generally circular shape so as to be freely rotatable within the track. Each token may further include a lowered peripheral edge supporting the token on the track. This arrangement reduces resistance to displacement of the tokens along the track by minimising friction between the tokens and the track.

In further arrangements each token preferably includes a pair of parallel and opposing sides arranged to engage respective side walls of the track for restricting pivotal movement of the token within the track as the token is slidably displaced along the track. The tokens may thus be circular with flattened sides, generally rectangular, hexagonal or octagonal in shape which is particularly useful when the mounting arrangement of the coin within the token is not symmetrical.

BRIEF DESCRIPTION OF THE DRAWINGS

In the accompanying drawings, which illustrate an exemplary embodiment of the present invention.

DETAILED DESCRIPTION

Figure 1:
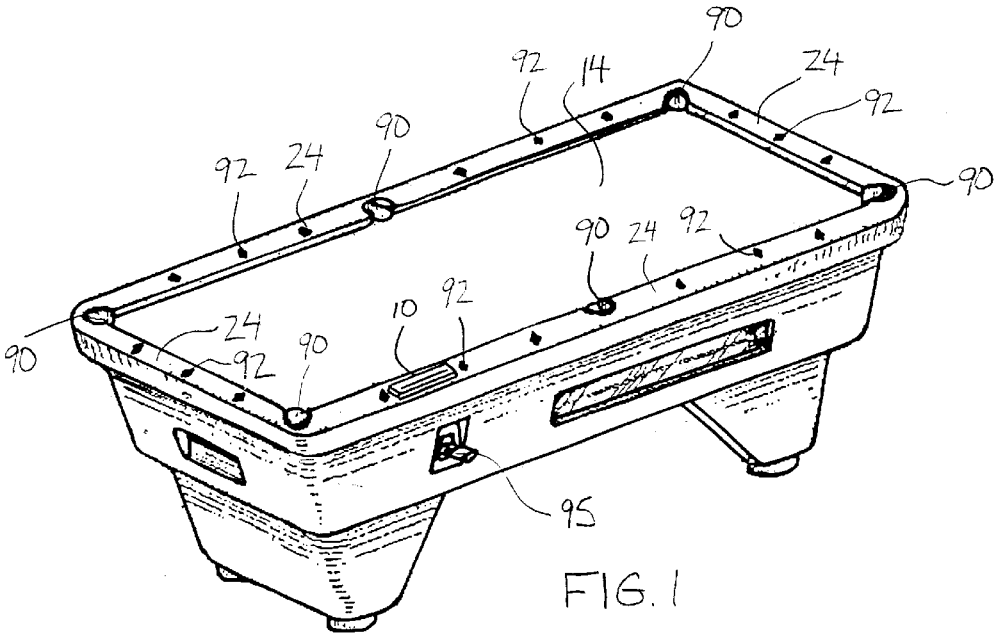
FIG. 1 is an isometric view of a pool table having the queuing system mounted thereon.

Referring to the accompanying drawings, there is illustrated a queuing system generally indicated by reference numeral 10. The system is generally arranged for queuing conventional coins 12 corresponding to a line of persons. The system 10 is particularly useful for coin operated pool tables 14 and the like where the use of coins are known for queuing a line of persons.

The queuing system 10 includes a housing 16 having a track 18 formed therein. The housing is generally formed of a base plate 20 and a cover plate 22 which are mounted together to form a elongate and generally flat rectangular shaped housing. As shown in FIG. 1, the housing 16 is thus arranged to mount on one of the rails 24 of a pool table 14 so as to provide minimal interference with the play of the game.

Figure 4:
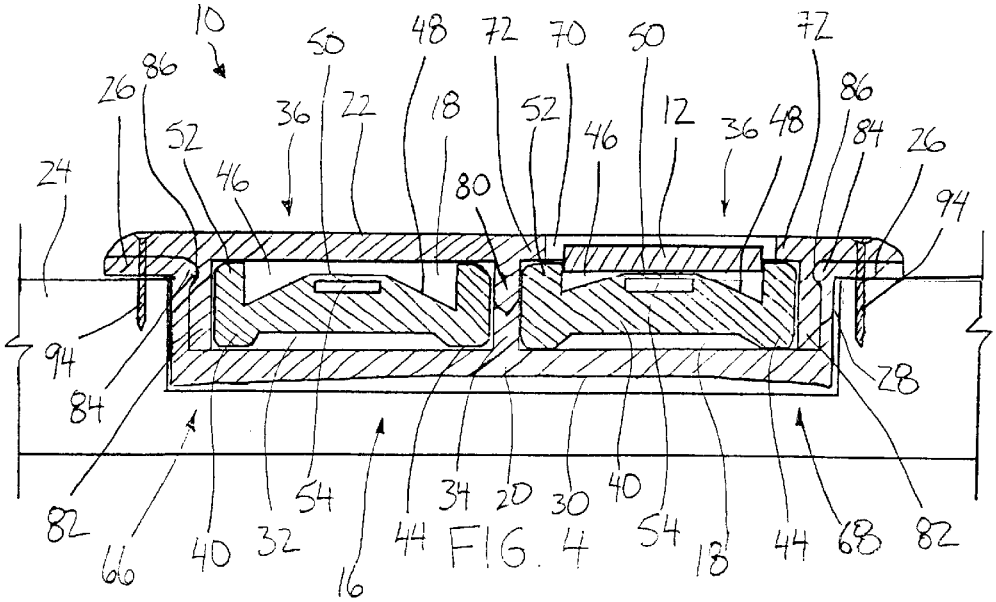
FIG. 4 is a sectional view along the line 4—4 of FIG. 2.
Figure 5:
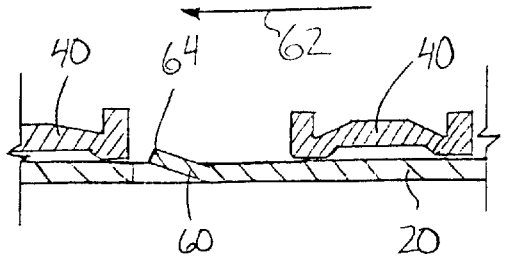
FIG. 5 is a sectional view along the line 5—5 of FIG. 3.

The base plate 20 is a generally rectangular plate having mounting flanges 26 extending laterally outward therefrom spaced upwardly from a bottom side of the base plate such that the flanges are arranged to support the base plate recessed into the surface of one of the rails 24 which has an opening 28 routered therein to accommodate the queuing system as shown in FIG. 4. The base plate includes a bottom surface 30 which is slightly concave so as to be adapted to mount flush on the top of the rail 24 of a pool table in an alternative mounting position.

An elongate and generally ovular shaped recess.32 is formed in a top side of the base plate and includes a lower rib 34 extending longitudinally down a center of the recess 32. The lower rib 34 has a height which is approximately half the depth of the recess 32 and is arranged to define the endless track 18 around it. The track 18 is formed by a pair of elongate and parallel sides 36 extending along opposing sides of the rib 34 and a pair of curved end portions 38 connected between respective ends of the elongate sides 36.

The track 18 thus comprises an endless trough for supporting tokens therein for sliding movement along the track. Each token is a traveller 40 which is generally circular in shape having a diameter which is approximately equal to the width of the track 18 and is intended to represent a person in a queue. A plurality of travellers 40 are provided so as to substantially fill the track when positioned end to end adjacent to each other with only a minimal clearance space 42 therebetween.

Each traveller includes a lowered peripheral ridge 44 for supporting the travellers on the track for sliding movement with minimal friction therebetween. The circular nature of the travellers permits free rotation of the traveller within the track which also assists in reducing friction as the travellers are slidably displaced along the track.

A circular indent 46 is located in a top side of each traveller 40 and is suitably sized to receive a standard size coin therein. A bottom surface of the circular indent 46 comprises an annular recess 48 located about a raised flat center 50 arranged to support the coin thereon. The flat center 50 is vertically spaced below a raised peripheral edge 52 of the traveller for retaining the coin therein against lateral displacement.

The annular recess 48 acts as a coin release mechanism by permitting an individual to release a coin from the traveller by pushing down on any edge of the coin for leveraging the opposing edge of the coin upward so as to be grasped by the individual. The flat center 50 thus acts as a fulcrum for supporting the coin centrally thereon.

The circular indent 46 further includes a magnetic insert 54 which further assists in retaining certain coins within their respective travellers 40. The magnetic inserts 54 also permit the housing 16 to be mounted on a generally vertical supporting surface while the arrangement of the travellers is still permitted to operate effectively.

Each traveller includes indicia 56 located thereon on the flat center 50 as well as on the raised peripheral edge 52 for associating which coin and which traveller belongs to which individual waiting in line. The indicia 56 include different types of common names or terms associated with pool for example, that persons may identify themselves with. The indicia 56 may further include different coloured travellers.

A stop member 60 is located within the track 18 on a bottom surface thereof for engaging the travellers 40 as they are rotated there past. The stop member 60 comprises an inclined finger which is biased to extend upwardly and oriented so as to permit the travellers to be displaced over the stop member in a camming action when the travellers are displaced in a first direction generally indicated by arrow 62.

Displacement of the travellers in the first direction acts to deflect the finger downwardly permitting the travellers to pass while displacement of the travellers in a second direction opposite to the first direction will result in a traveller engaging the free end 64 of the stop member 60 thus restricting further rotation of any of the travellers in the second direction. The clearance space 42 between adjacent travellers provides a clearance space to accommodate the stop member 60 in an undeflected position as shown in the Figures.

The cover plate 22 is a generally rectangular plate which is arranged to extend across a top side of the base plate 20 and a top side of the mounting flanges 26. The cover is generally arranged to enclose a return side 66 of the track having empty travellers therein while leaving a queuing side 68 of the track exposed so as to permit access to coins on the travellers therein.

Figure 2:
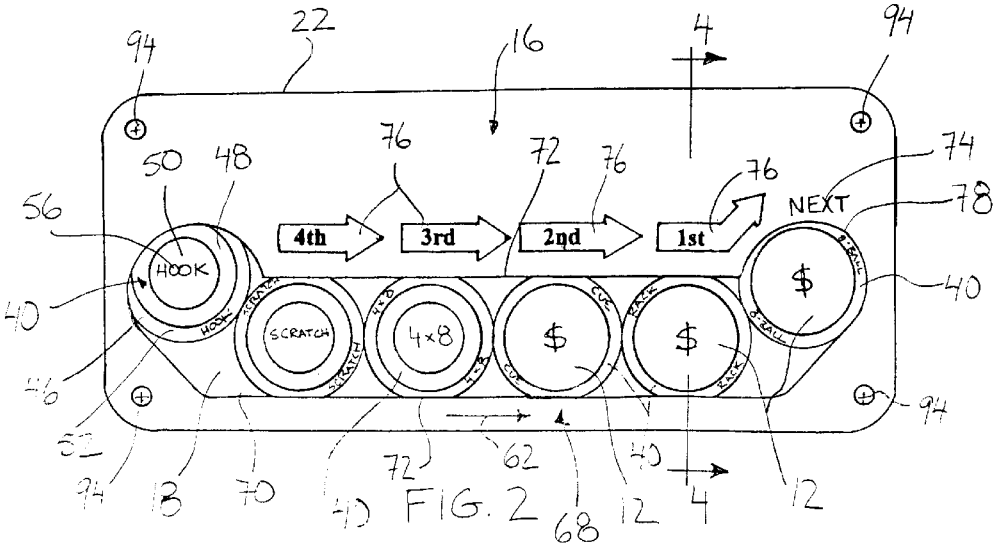
FIG. 2 is a top plan view of the queuing system.
Figure 3:
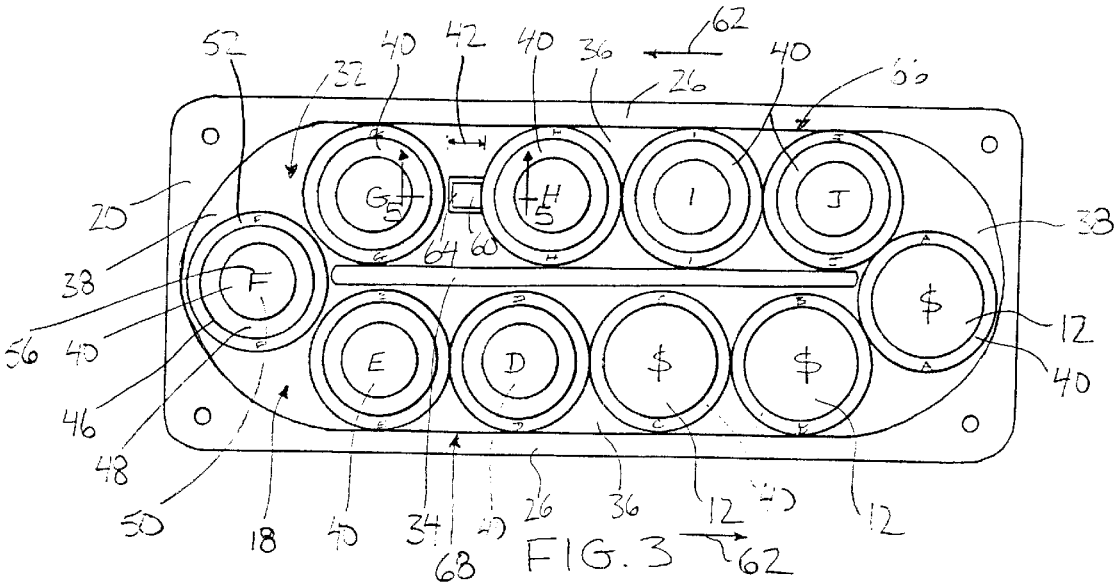
FIG. 3 is a top plan view of the queuing system, shown with the cover removed.

A generally crescent shaped opening 70 in the cover plate 22 provides access to the coins in the travellers located on the queuing side 68 of the track while defining a pair of retaining flanges 72 formed integrally within the cover plate 22 for extending partway over the raised peripheral edges 52 of the respective travellers in the queuing side 68 as shown in FIG. 2 for retaining the travellers within the track while leaving the circular indent 46 of the travellers exposed to permit access to the coins supported therein.

An indicator 74 is located at a first end of the opening 70 wherein rotation of the travellers in the first direction corresponds to displacement of the travellers in the queuing side 68 toward the indicator 74. The indicator 74 indicates which coin is next in the queuing order. Further indicia 76 are located on the cover plate 22 for indicating the subsequent runner up positions of the coins located in the queuing side 68 for indicating the remainder of the queuing order.

The first end 78 of the opening 70 is spaced above the travellers so as to provide sufficient clearance for a traveller to pass thereunder while being sufficiently close to the travellers so as to act as a stop member for restricting the passage of a traveller having a coin supported thereon through the track to the return side 66 thereof. The stop member arrangement of the cover plate 22 thus ensures that the travellers cannot be rotated from the queuing side to the return side 66 until the coin supported thereon has been removed.

In order to mate with the base plate 20 the cover plate includes a center rib 80 which extends downwardly therefrom in alignment with the lower rib 34 of the base plate. The cover plate further includes a pair of sides 82 which extend downwardly from opposing sides of the cover plate so as to be received within the sides 36 of the recess in the bottom plate. A ridge 84 extending inwardly from a periphery of the recess 32 of the base plate is arranged to be received within a longitudinally extending groove 86 within each side 82 for securing the cover plate on top of the base plate 20. The sides 82 of the cover plate forms the outer sides of the track 18 while the lower rib 34 forms the inner side of the track such that the width of the track is defined therebetween.

In further embodiments the base plate may be used without the cover plate for supporting the travellers therein in a similar arrangement to the previously described embodiment. The travellers may also be replaced with the conventional coins 12 themselves instead of the use of separate travellers for supporting the coins thereon as described above such that each coin acts as a token to represent a person in the queue. The coins would thus be supported within the track 18 for sliding movement therealong as the travellers are described above. When using the base plate without the cover, the indicator 74 and the indicia 76 for indicating which travellers are next in the queuing order would be located on the base plate itself as opposed to on the cover plate.

In use a person who wishes to reserve their spot in line would place a coin in the next available traveller 40 to mark their position in the queue. When the next person is to be called from the queue, the persons whose coin is located adjacent the indicator 74 picks up their coin and advances the travellers in the first direction until the next coin engages the first end 78 of the opening in the cover adjacent the indicator 74. Persons continue to add coins to mark their position and advance the travellers according to the queuing order as persons are next due in line.

The circular indent 46 in the travellers may be sized to accommodate a particular sized coin for example a dollar, or a maybe of a general size which is able to accommodate most standard size coins therein.

The housing 16 is generally arranged to fit between one of the pockets 90 of the pool table and one of the sights 92 located between adjacent pockets, or between two adjacent sights. The housing thus does not interfere with the play of the game. The housing may include one of the sights 92 incorporated thereon such that the housing may be longer than the distance between adjacent sights 92 of the pool table without affecting the playing area of the pool tables. In such longer versions as many as twelve travellers or more may be visible at one time. The housing is further arranged to be mounted on the rails 24 of the pool table adjacent a coin operating mechanism 95 of the pool table as indicated in FIG. 1.

The queuing system can be retrofit or installed by manufacturers by routering an opening 28 into one of the rails 24 of the pool table as shown in FIG. 4. Mounting screws 94 are thus used to secure the base plate and cover plates to the pool table rail. In an alternative mounting arrangement the base plate may also be mounted flush on a top side of one of the rails as shown in dotted line in FIG. 4.

The housing 16 can be formed of plastic material which has been moulded into the desired shape. The use of plastic permits the housing 16 and the travellers 40 to be moulded in different colours with varying types of indicia thereon as desired.

Figure 6:
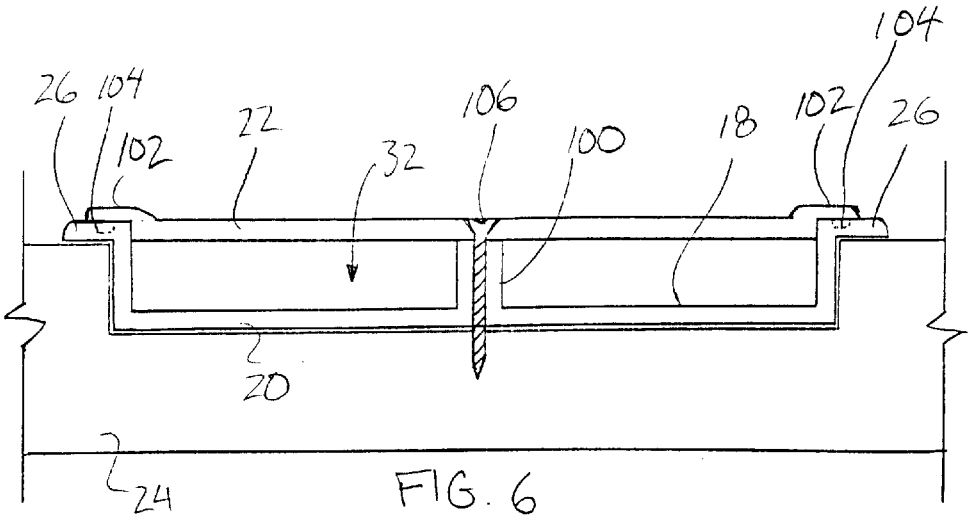
FIG. 6 is a sectional view similar to that of FIG. 4 of a different embodiment of the queuing system.

In an alternative embodiment as illustrated in FIG. 6, the base plate 20 is arranged to be recessed into one of the rails 24 of a conventional pool table. Similarly to the previous embodiment, the base plate includes an ovular shaped recess 32 formed in a top side thereof with a rib 100 extending longitudinally down a center of the recess 32 for forming an oval shaped track 18 about the rib. Travellers 40 are thus supported for sliding movement along the track similarly to the previous embodiment.

The cover plate 22 comprises a flat plate member having a peripheral flange 102 which extends laterally outward from a top side of the cover plate 22 so as to be supported on the mounting flanges 26 of the base plate which are similar to those described in the previous embodiments. The peripheral flanges 102 include respective locator pins 104 for alignment with respective apertures in the mounting flanges 26 so as to properly aligned the cove plate 22 with the base plate 20 when supported thereon.

A pair of mounting screws 106 are spaced apart along the rib 100 to extend through both the cover plate 22 and the base plate 20 to be secured to the rail 24 of the pool table there below. The mounting screws 106 are recessed into the top surface of the cover plate 22 while the cover plate 22 is recessed into the recess 32 of the base plate such that only the mounting flanges 26 and the peripheral flanges 102 extend upwardly passed the top side of the rail in mounted position so as to provide minimal obstruction in use.

Figure 7A:
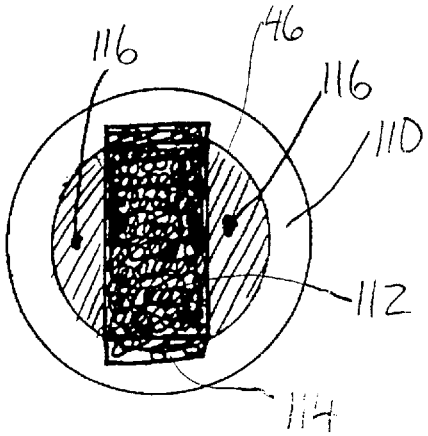
FIGS. 7A and 7B are respective top plan and partly sectional side elevational views of an alternative embodiment of one of the tokens.
Figure 7B:
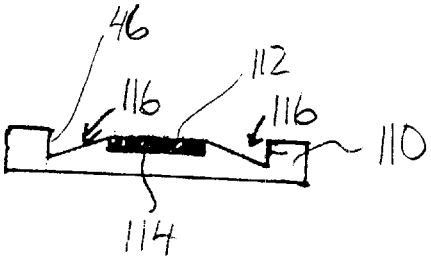

An alternative embodiment of a traveller 110 is shown in FIGS. 7A and 7B. Each traveller 110 is similarly arranged to the previous embodiment wherein there is provided a circular indent 46 in a top side of the traveller for receiving a coin therein. A raised central portion 110 however, is formed by an elongate magnet 114 which extends laterally across the circular indent 46 so as to define a pair of crescent shaped recesses 116 on each side thereof. The crescent shaped recesses 116 are similarly arranged to the annular recess 48 of the previous embodiment such that a coin supported on the flat central portion 112 can be released from the traveller by depressing a peripheral edge of the coin into one of the crescent shaped recesses 116 whereby the magnet 114 acts as a fulcrum for leveraging the opposing peripheral edge of the coin upward.

Figure 8A:
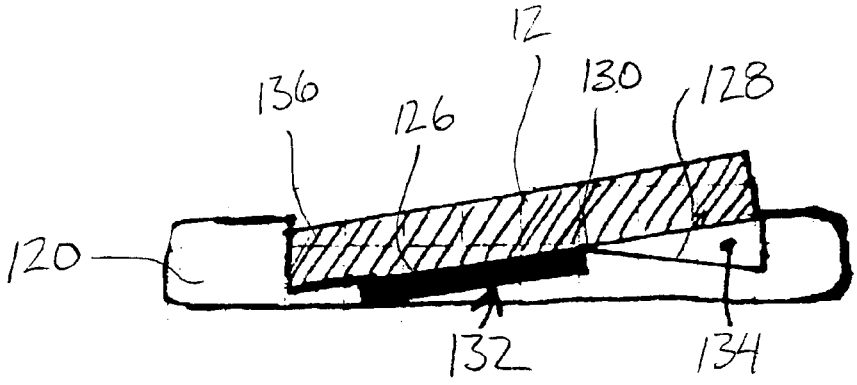
FIGS. 8A and 8B are respective partly sectional side elevational and top plan views of yet another embodiment of one of the tokens.
Figure 8B:
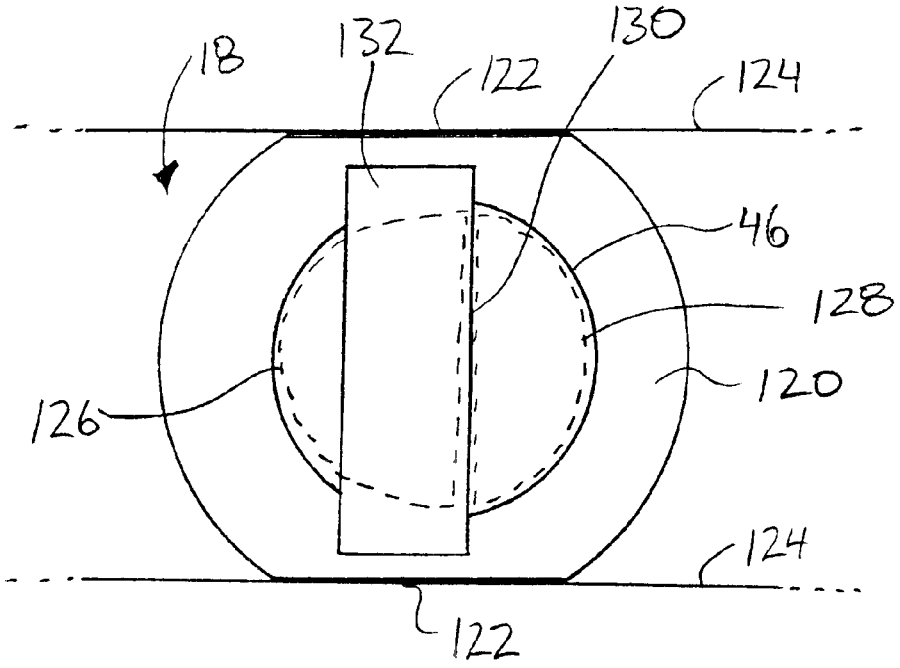

As illustrated in FIGS. 8A and 8B a further embodiment of a traveller 120 is illustrated. In this arrangement the opposing sides 122 of the traveller are generally flat and parallel for engaging opposing side walls 124 of the track 18 to resist rotation of the traveller 120 within the track as the tokens are slidably displaced along the track. The circular indent 46 is thus permitted to be asymmetrical from front to rear about a lateral axis extending across the traveller 120. In this arrangement the circular indent 46 includes a rearward portion 126 and a forward portion 128 which are inclined upwardly towards each other to meet at a laterally extending fulcrum 130 dividing the forward and rearward portions. The travellers 120 are further arranged as in the previous embodiments to be displaced in the track only in a forward direction to advance the travellers towards the indicator as described above.

An elongate magnet 132 extends laterally across the circular indent 46 and is positioned so as to be flush with the rearward portion 126 of the circular indent. The rearward portion 126 is greater in surface area than the forward portion 128 and is arranged to substantially support the coin 12 thereon. When the coin is supported on the rearward portion 126 the forward portion 128 forms a crescent shaped recess 134 below a forward peripheral edge of the coin 12 such that depressing the forward peripheral edge of the coin into the crescent shaped recess 134 will raise a rear end 136 of the coin to release the coin from the traveller 120.

In a further embodiment of the track which is not shown in the Figures, the travellers may be mounted so as to be selectively removable from the track. This arrangement would allow persons to provide their own custom traveller with a personal identification thereon. A back section of the track is selectively separable from the remainder of the track in this embodiment to provide access to the interior of the track, so a person may remove one of the default travellers and replace it with their own as well as remove their custom traveller from the track when departing.

While various embodiments of the present invention have been described in the foregoing, it is to be understood that other embodiments are possible within the scope of the invention. The invention is to be considered limited solely by the scope of the appended claims.

What is claimed is:

1. A queuing system comprising:

a plurality of tokens;

an endless track supporting the tokens therein for sliding movement in a first direction along the track; and an indicator on the track corresponding to a first token to be queued;

wherein the first direction corresponds to displacement of the tokens towards the indicator for indicating a queuing order.

2. The queuing system according to claim 1 wherein the tokens comprise conventional coins.

3. The queuing system according to claim 1 wherein there is provided indicia on the track in alignment with the tokens in the track, the indicia corresponding to the positions in the queue representing the respective tokens.

4. The queuing system according to claim 1 wherein there is provided a stop member arranged to engage the tokens to restrict displacement of the tokens in a second direction opposite the first direction.

5. The queuing system according to claim 1 wherein the endless track is formed by a pair of elongate and parallel side portions and a pair of curved end portions coupled between respective ends of the side portions.

6. The queuing system according to claim 1 wherein the track includes mounting means for mounting the track on an upright supporting surface.

7. The queuing system according to claim 1 wherein there is provided a mounting flange extending laterally outward from the track and spaced upwardly from a bottom side of the track for mounting the track recessed into a supporting surface.

8. A queuing system for queuing conventional coins, the queuing system comprising:

a plurality of tokens, each token being arranged to support one of the conventional coins therein;

an endless track mounting the tokens therein for sliding movement in a first direction along the track; and an indicator on the track for indicating which token corresponds to a first coin to be queued;

wherein the first direction corresponds to displacement of the tokens towards the indicator for indicating a queuing order of the coins.

9. The queuing system according to claim 8 wherein there is provided a stop member arranged to engage the tokens to restrict displacement of the tokens in a second direction opposite the first direction.

10. The queuing system according to claim 8 wherein the tokens substantially fill the track.

11. The queuing system according to claim 8 wherein each token includes a coin release mechanism arranged to release a coin from the token.

12. The queuing system according to claim 11 wherein there is provided a circular indent in each token suitably sized to receive the coin therein and wherein the coin release mechanism comprises a recessed portion adjacent a periphery of the indent.

13. The queuing system according to claim 12 wherein the circular indent comprises a flat central portion for supporting the coin thereon and wherein the recessed portion comprises an annular recess about a periphery of the circular indent.

14. The queuing system according to claim 8 wherein there is provided a stop member adjacent the indicator on the track arranged to restrict displacement of the tokens in the first direction past the stop member until a coin supported thereon has been removed.

15. The queuing system according to claim 8 wherein there is provided a flange mounted along the track to extend partially over the tokens so as to restrict removal of the token from the track.

16. The queuing system according to claim 8 wherein there is provided a magnetic element mounted within each token for assisting in supporting the coins on the respective tokens.

17. The queuing system according to claim 8 wherein each token includes a different indicia thereon for indicating which person corresponds to each coin supported on the tokens.

18. The queuing system according to claim 8 wherein each token includes a lowered peripheral edge supporting the token on the track.

19. The queuing system according to claim 8 wherein the track comprises a trough supporting the tokens for sliding movement along the trough and wherein the tokens are generally circular in shape so as to be freely rotatable within the track.

20. The queuing system according to claim 8 wherein each token includes a pair of parallel and opposing sides arranged to engage respective side walls of the track for restricting pivotal movement of the token within the track as the token is slidably displaced along the track.

* * * * *